US010786135B2

(12) United States Patent
Thyson et al.

(10) Patent No.: US 10,786,135 B2
(45) Date of Patent: Sep. 29, 2020

(54) MOP HEAD AND MOP

(71) Applicant: Carl Freudenberg KG, Weinheim (DE)

(72) Inventors: Diana Thyson, Bad Duerkheim (DE); Antonio Moreno Del Rio, Castellar del Valles (ES)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 16/308,489

(22) PCT Filed: Jun. 13, 2017

(86) PCT No.: PCT/EP2017/064387
§ 371 (c)(1),
(2) Date: Dec. 10, 2018

(87) PCT Pub. No.: WO2017/220376
PCT Pub. Date: Dec. 28, 2017

(65) Prior Publication Data

US 2019/0269293 A1 Sep. 5, 2019

(30) Foreign Application Priority Data

Jun. 22, 2016 (DE) ..... 10 2016 007 543

(51) Int. Cl.

| | |
|---|---|
| ***A47L 13/252*** | (2006.01) |
| ***A47L 13/255*** | (2006.01) |
| ***A47L 13/42*** | (2006.01) |
| ***A47L 13/44*** | (2006.01) |

(52) U.S. Cl.
CPC ..... *A47L 13/42* (2013.01); *A47L 13/252* (2013.01); *A47L 13/255* (2013.01); *A47L 13/44* (2013.01)

(58) Field of Classification Search
CPC ..... A47L 13/42; A47L 13/44; A47L 13/252; A47L 13/255
See application file for complete search history.

(56) References Cited

U.S. PATENT DOCUMENTS

| | | | | |
|---|---|---|---|---|
| 3,336,620 | A | 8/1967 | Marie | |
| 3,501,796 | A | 3/1970 | Moss | |
| 4,114,224 | A | 9/1978 | Disko | |
| 4,245,368 | A * | 1/1981 | Cotey | A47L 13/24 15/229.1 |
| 5,784,746 | A | 7/1998 | Williams et al. | |
| 6,253,408 | B1 | 7/2001 | Feld et al. | |
| 2008/0016640 | A1 | 1/2008 | Reddy et al. | |

(Continued)

FOREIGN PATENT DOCUMENTS

| | | | |
|---|---|---|---|
| CH | 617081 | A5 | 5/1980 |
| DE | 1428470 | A | 12/1968 |
| DE | 2325977 | A | 12/1974 |

(Continued)

*Primary Examiner* — Randall E Chin
(74) *Attorney, Agent, or Firm* — Leydig, Voit & Mayer, Ltd.

(57) ABSTRACT

A mop head includes: fringe-shaped cleaning textiles; and a cap-shaped carrier body. The cleaning textiles are secured to the carrier body. At least some of the cleaning textiles are interconnected by an integral bond and are combined to form a pre-assemblable unit. The pre-assemblable unit and the carrier body are interconnected.

11 Claims, 2 Drawing Sheets

(56) References Cited

U.S. PATENT DOCUMENTS

2015/0374197 A1* 12/2015 Suda ..... A47L 13/38
15/114

FOREIGN PATENT DOCUMENTS

| | | | |
|---|---|---|---|
| DE | 69506446 | T2 | 6/1999 |
| DE | 19833553 | C1 | 12/1999 |
| DE | 19951780 | A1 | 5/2001 |
| EP | 0537963 | A1 | 4/1993 |
| EP | 1129658 | A1 | 9/2001 |
| GB | 994131 | A | 6/1965 |
| WO | WO 9740735 | A1 | 11/1997 |

* cited by examiner

MOP HEAD AND MOP

CROSS-REFERENCE TO PRIOR APPLICATIONS

This application is a U.S. National Phase application under 35 U.S.C. § 371 of International Application No. PCT/EP2017/064387, filed on Jun. 13, 2017, and claims benefit to German Patent Application No. DE 10 2016 007 543.0, filed on Jun. 22, 2016. The International Application was published in German on Dec. 28, 2017 as WO 2017/220376 under PCT Article 21(2).

FIELD

The invention relates to a mop head and a mop comprising said mop head, wherein the mop head comprises fringe-shaped cleaning textiles and a cap-shaped carrier body, and wherein the cleaning textiles are secured to the carrier body.

BACKGROUND

Such a mop head and such a mop are known from EP 1 129 658 A1.

The carrier body comprises a carrier plate, wherein a flexible loop in the manner of a cable tie can be fastened to the carrier plate on the side facing the surface to be cleaned. The fringe-shaped cleaning textiles are loosely associated with one another, combined as a loose bundle, and secured to the carrier body by the flexible loop. The cleaning textiles are pinched between the loop and the carrier plate and are essentially held non-positively in their position.

It should be noted, however, that the individual cleaning textiles are held in their position only insufficiently during the intended use of the mop head, in particular when cleaning agents reducing the static friction between the cleaning textiles are used and/or the cleaning textiles are subjected to tensile stress, for example when the cleaning textiles catch on edges of the surfaces to be cleaned.

SUMMARY

In an embodiment, the present invention provides a mop head, comprising: fringe-shaped cleaning textiles; and a cap-shaped carrier body, wherein the cleaning textiles are secured to the carrier body, wherein at least some of the cleaning textiles are interconnected by an integral bond and are combined to form a pre-assemblable unit, and wherein the pre-assemblable unit and the carrier body are interconnected.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 an exemplary embodiment of the mop according to the invention with the mop head according to the invention, the mop head being completed with the handle to form the mop, FIG. 2 a view of the pre-assemblable unit from above or from below, in the region of the two connecting regions.

DETAILED DESCRIPTION

Figure 1:
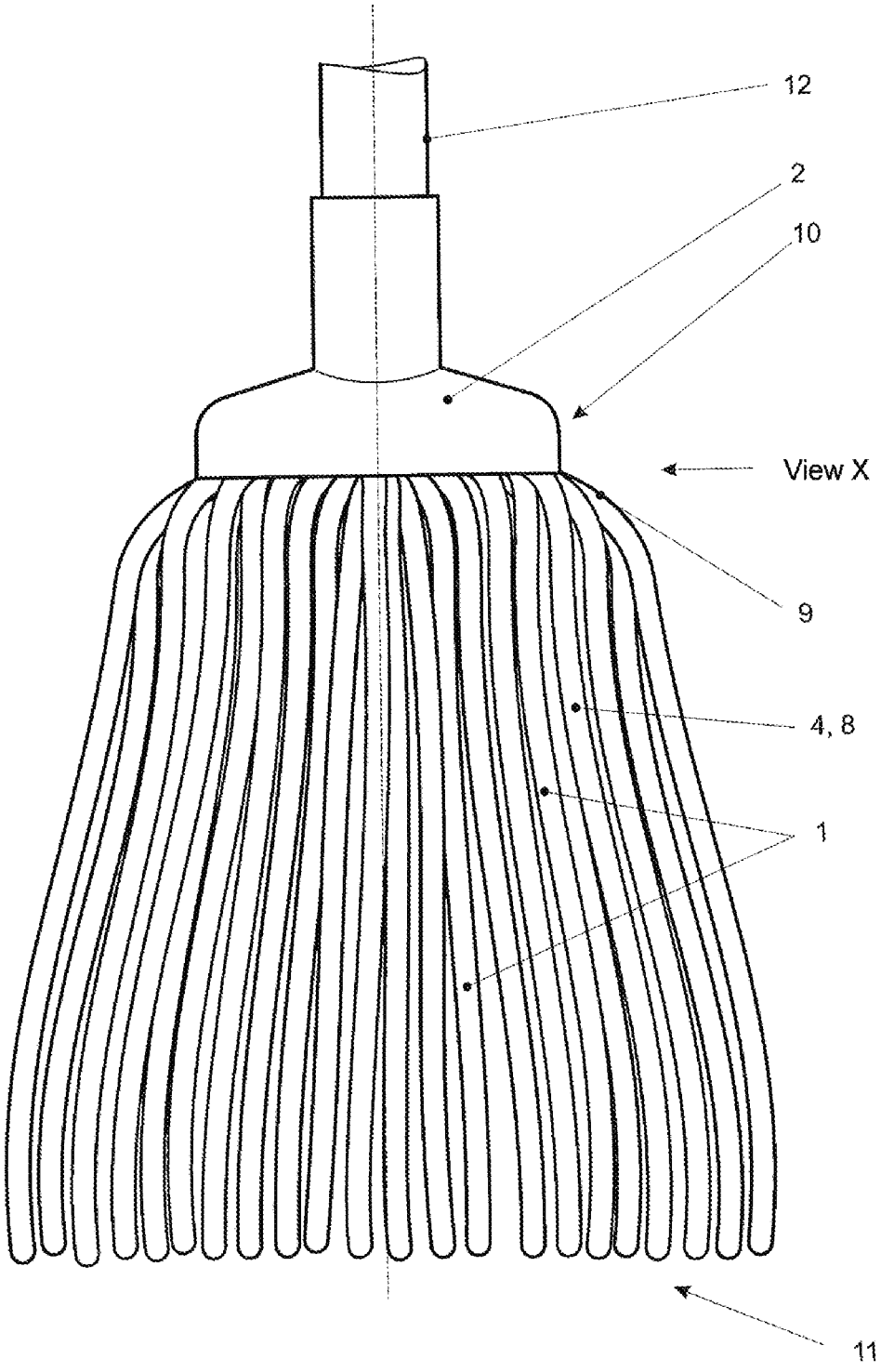
FIGS. 1 and 2 schematically show, in each case.

The invention is based on the object to respectively further develop a mop head, and a mop comprising said mop head, in such a way that the cleaning textiles are held reliably in their respective position during the intended use of mop head and mop, and in such a way that the mop head and the mop therefore have consistently good performance characteristics during a long service life.

In order to achieve the object, it is provided that at least some of the cleaning textiles, preferably all cleaning textiles, are interconnected by an integral bond and are combined to form a pre-assemblable unit, and that the pre-assemblable unit and the carrier body are interconnected.

For the durability of the mop head, and in order to ensure consistently good performance characteristics of the mop during a long service life, it is of decisive importance that the cleaning textiles are interconnected by an integral bond. The cleaning textiles are thereby fixed in their position relative to one another. Even if a cleaning liquid added to a cleaning agent is used and the cleaning agent reduces the static friction between the cleaning textiles, and/or if the cleaning textiles catch on edges during the intended use, this has no adverse effect on the positioning of the cleaning textiles relative to one another and on the service life of the mop. As a result of the integral bond of the cleaning textiles, the pre-assemblable unit is especially dimensionally stable, so that consistently good performance characteristics are always ensured during the entire service life.

The connection of the pre-assemblable unit to the carrier body may take place in a conventional manner, for example by providing a clamping connection.

By combining the cleaning textiles in the pre-assemblable unit, the assembly of the mop head/mop is particularly simple because only a few parts have to be mounted to one another. The cleaning textiles are secured to the carrier body as a unit.

According to an advantageous embodiment, it may be provided that the pre-assemblable unit has at least one first connection region in which the cleaning textiles are combined and interconnected by an integral bond. The cleaning textiles are arranged stationary relative to one another in the connecting region. A relative movement of the cleaning textiles in the connection region cannot take place.

The pre-assemblable unit may have a first and a second connection region, wherein in both connection regions, the cleaning textiles are always combined and interconnected by the integral bond. The mechanical load per connection region, relative to only one connection region, is reduced by the second connection region. The safeguard against tearing out single cleaning textiles, or parts thereof, from the pre-assemblable unit is increased by the provision of two connecting regions.

The two connection regions may be associated with one another, adjacently with a clearance. Such an embodiment may in particular be advantageous if the cleaning textiles are arranged loosely relative to one another within the clearance, without a connection, and are thereby comparatively voluminous with respect to the connecting regions. For a durable and reliable clamping of the unit on the carrier body, the larger and more strongly deformable volumes of the cleaning textiles in the clearance may be advantageous.

In general, the integral bond of the cleaning textiles to one another can be carried out in different ways.

An integral bond of the cleaning textiles to one another, which is formed by ultrasonic welding, has proven to be particularly advantageous. Such an ultrasonic weld has the advantage that it can be performed reliably, rapidly, and inexpensively. The ultrasonic weld is created in the connecting regions, wherein due to the welding, the connecting regions have a relatively smaller volume relative to the adjacent regions of the unit. The cleaning textiles are at least partially fused together in the connecting regions.

In the ready-to-use state of the mop head, the pre-assemblable unit may have a substantially bell-shaped form, wherein the first, or the first and the second, connection region are arranged essentially at the apex of the pre-assemblable unit. A bell-shaped form of cleaning textiles is known per se, for example from the aforementioned EP 1 129 658 A1.

In the mop head according to the invention, however, it is advantageous that the essentially bell-shaped form is maintained unchanged by the integral bond of the cleaning textiles to one another during the entire service life of the mop head, because a relative displacement of the cleaning textiles relative to one another is reliably precluded.

The pre-assemblable unit may be secured to the carrier body by means of a pin. The pre-assemblable unit is held non-positively and/or positively at the carrier body by the pin. A positive fit may, for example, take place in that the carrier body has a surface profile on the side facing toward the unit, which surface profile positively engages in the unit.

The carrier body may consist of a polymer material and have a seat for the pin. Carrier bodies made of a polymer material have proven themselves for cleaning devices. Such carrier bodies are simple and inexpensive to manufacture and resistant to conventional cleaning agents.

According to an advantageous embodiment, it may be provided that the carrier body completely covers the connection regions. Via such an embodiment, the connecting regions are well protected against external influences. In addition, the mop head thereby has an aesthetic appearance because only cleaning textiles that are not integrally bonded and are loosely associated with one another emerge below the cap-shaped carrier body.

The cleaning textiles may be designed as cleaning threads, cleaning yarns, or cleaning strips. The cleaning threads, cleaning yarns, or cleaning strips may easily be adapted, with regard to their tasks, to the respective conditions of the application. The cleaning threads, cleaning yarns, or cleaning strips may thereby be optimized with regard to cleaning performance, water absorption, or water release, for example.

The mop, comprising the mop head described above, moreover comprises a handle, the mop head and the handle being connected to one another.

An embodiment of the mop according to the invention is shown in FIG. 1. The mop comprises the mop head 11 with its fringe-shaped cleaning textiles 1 and the cap-shaped carrier body 2.

In this exemplary embodiment, the cleaning textiles 1 are designed as cleaning threads or cleaning yarns and are secured to the carrier body 2, which consists of a polymer material.

All cleaning textiles 1 are interconnected by an integral bond 3 in the form of an ultrasonic weld and are combined to form the pre-assemblable unit 4. In the ready-to-use state of the mop head 1 shown here, the pre-assemblable unit 4 has a substantially bell-shaped form 8 and is held non-positively and/or positively on the carrier body 2 by the schematically illustrated pin 10.

Figure 2:
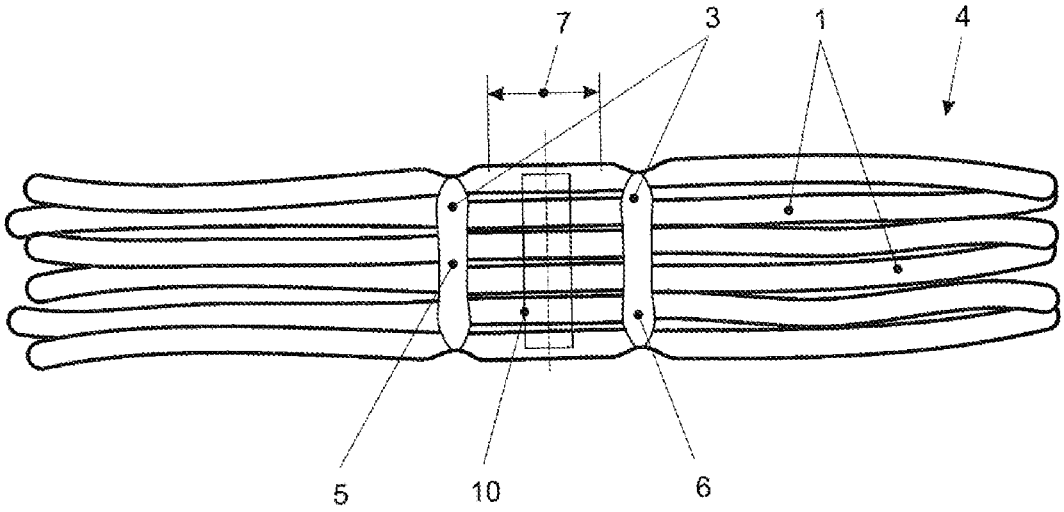

A detail of the pre-assemblable unit 4 is shown in FIG. 2. The cleaning textiles 1 are interconnected by the integral bond 3 in the form of an ultrasonic weld to form the pre-assemblable unit 4, the pre-assemblable unit 4 having the two connection regions 5, 6 shown here.

The two connecting regions 5, 6 are associated with one another with a clearance 7 and, in the ready-to-use state of the mop as shown in FIG. 1, are arranged substantially at the apex 9 of pre-assemblable unit 4.

In the ready-to-use state of the mop head 11, the carrier body 2 completely covers the connecting regions 5, 6.

As can be seen in FIG. 2, the material of which the cleaning textiles 1 consist is welded in the region of the integral bond 3; in this region, the cleaning textiles 1 are at least partially fused together, and the unit 4 therefore has a relatively smaller volume in the connection regions 5, 6.

In practice, the mop shown in FIG. 1 comprises only three individual parts, so that the installation is simple and the risk of assembly errors is limited to a minimum. The mop consists of the unit 4, installed on the carrier body 2, and the handle 12.

All fringe-shaped cleaning textiles 1 are interconnected by the integral bond 3 so that they cannot be lost, wherein the position of the cleaning textiles 1 relative to one another is fixed in a simple manner via the integral bond 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A mop head, comprising:

fringe-shaped cleaning textiles; and a cap-shaped carrier body, wherein the cleaning textiles are secured to the carrier body, wherein at least some of the cleaning textiles are interconnected by an integral bond and are combined to form a pre-assemblable unit, wherein the pre-assemblable unit and the carrier body are interconnected, wherein the pre-assemblable unit has a first connection region and a second connection region, wherein the cleaning textiles are combined and interconnected by the integral bond in both connection regions respectively, wherein the two connecting regions are associated with one another, adjacently with a clearance, and wherein the cleaning textiles are arranged loosely within the clearance without connection to one another so as to be, based on the integral bond, comparatively voluminous with respect to the connecting regions.

2. The mop head according to claim 1, wherein all cleaning textiles are interconnected by the integral bond and are combined in the pre-assemblable unit.

3. The mop head according to claim 1, wherein the pre-assemblable unit has at least one first connection region in which the cleaning textiles are combined and interconnected by the integral bond.

4. The mop head according to claim 1, wherein the integral bond of the cleaning textiles comprises an ultrasonic weld.

5. The mop head according to claim 1, wherein, in a ready-to-use state of the mop head, the pre-assemblable unit has a substantially bell-shaped form, and wherein the first or the first and the second connection region are arranged substantially at an apex of the pre-assemblable unit.

6. The mop head according to claim 1, wherein the pre-assemblable unit is secured to the carrier body, pinched by a pin.

7. The mop head according to claim 6, wherein the carrier body comprises a polymer material and has a seat for the pin.

8. The mop head according to claim 1, wherein the carrier body completely covers the connection regions.

9. The mop head according to claim 1, wherein the cleaning textiles comprise cleaning threads, cleaning yarns, or cleaning strips.

10. The mop head according to claim 1, wherein the carrier body has a surface profile on a side thereof facing the pre-assemblable unit.

11. A mop, comprising:

a mop head, comprising:

fringe-shaped cleaning textiles; and a cap-shaped carrier body, wherein the cleaning textiles are secured to the carrier body, wherein at least some of the cleaning textiles are interconnected by an integral bond and are combined to form a pre-assemblable unit, wherein the pre-assemblable unit and the carrier body are interconnected, wherein the pre-assemblable unit has a first connection region and a second connection region, wherein the cleaning textiles are combined and interconnected by the integral bond in both connection regions respectively, wherein the two connecting regions are associated with one another, adjacently with a clearance, and wherein the cleaning textiles are arranged loosely within the clearance without connection to one another so as to be, based on the integral bond, comparatively voluminous with respect to the connecting regions; and a handle, wherein the mop head and the handle are connected to one another.

* * * * *